United States Patent [19]

Henry

[11] 4,454,858

[45] Jun. 19, 1984

[54] DRAW LENGTH INDICATOR FOR HUNTING BOW

[76] Inventor: Thomas J. Henry, 593 Sand Creek Rd., Albany, N.Y. 12203

[21] Appl. No.: 318,825

[22] Filed: Nov. 6, 1981

[51] Int. Cl.[3] ..... F41B 5/00

[52] U.S. Cl. ..... 124/88; 124/41 B

[58] Field of Search ..... 124/86, 41 B, 24 R, 124/88, 32; 33/265

[56] References Cited

U.S. PATENT DOCUMENTS

| | | | |
|---|---|---|---|
| 3,450,122 | 6/1969 | Diamond | 124/24 R |
| 3,463,117 | 8/1969 | Killian | 124/24 R |
| 3,866,592 | 2/1975 | Carella | 124/24 R |
| 4,134,383 | 1/1979 | Flood | 124/24 R |
| 4,179,613 | 12/1979 | Koren | 33/265 X |

*Primary Examiner*—Richard J. Apley
*Assistant Examiner*—William R. Browne
*Attorney, Agent, or Firm*—Lawrence D. Cutter

[57] ABSTRACT

A hunting bow is provided with a device for repeatedly signalling the exact length of bow string draw for an archer. The indicator particularly includes magnetic switch disposed in a forward position with respect to the body of the bow so as to be able to accommodate the use of arrows having broadhead tips. Furthermore, the indicator is multiply adjustable not only to accommodate the various types of arrows which are currently employed, but also to provide controllable sensitivity. The device provides an indication that the arrow is being drawn straight back. Lastly, the draw length indicator is detachably mountable to many of the archery bows which are currently in use.

7 Claims, 8 Drawing Figures

DRAW LENGTH INDICATOR FOR HUNTING BOW

BACKGROUND OF THE INVENTION

This invention relates to archery bows and more particularly to a draw length indicator for indicating the proper bow tension for arrow release.

For consistent accuracy of performance in the sport of archery, it is generally necessary to draw the arrow and bow string back to a certain predetermined point prior to release of the arrow. The distance through which the tail of the arrow is drawn is generally referred to as the draw length. This draw length is a variable which changes with different archery participants and is a function of their body dimensions, particularly their arm length. In order to assure consistency in the force exerted in drawing the bow, it is desirable to have some indications that the tip of the arrow is properly positioned with respect to the shank portion of the bow. This determination is difficult for the archer to make since his attention is typically being employed to aim the device and direct sighting of the tip of the arrow can be difficult.

Other individuals skilled in the archery art have realized the desirability of employing a draw length indicator. For example, in U.S. Pat. No. 3,450,122, issued June 17, 1969 to Clyde Diamond there is apparently disclosed a bow and arrow mechanism utilizing a magnet carried by a central portion of the bow which magnetically energizes a tip end of the arrow which in turn energizes and closes a switch when the arrow and its head have been drawn back to a proper shooting position. However, the device illustrated in the Diamond patent possesses several significant disadvantages. In particular, a significant amount of the activity undertaken by archery enthusiasts involves the sport of hunting using the bow and arrow with what is known as a broadhead tip. Such a tip is more particularly illustrated in FIG. 3 which is described and discussed below. In the device illustrated in the aforementioned patent, an energizing magnet is disposed in the shank of the bow itself and does not permit the use of arrows possessing broadhead, or hunting, tips. The Diamond device does not work with these hunting arrows because these broadhead tips do not clear the body of the bow and fail to reach the energizing magnet. Furthermore, the use of the device in the Diamond patent requires that the bow be bored to allow for insertion of batteries. Furthermore, the required boring must be done at the highly stressed midportion of the bow limb. Additionally, the device disclosed in the Diamond patent is inoperable for newer type bows. Lastly, this device requires special fitting and adaptation to each bow.

Another draw length indicating device is apparently disclosed in U.S. Pat. No. 4,179,613 issued Dec. 18, 1979, to James T. Koren. This device depends upon a photoelectric detector to sense when the head of the arrow has passed to provide an indicating signal that the draw length is proper. However, this device also possesses significant disadvantages, particularly for the hunting archer. Specifically, the use of a photocell necessarily makes the sensor's sensitivity dependent upon ambient light conditions. While the Koren device appears to be able to adjust its sensitivity, nonetheless light conditions can change rapidly particularly at the hours of dawn and dusk. Such sensitivity adjustments can be a significant distraction to the hunter. Furthermore, and even more importantly, the device in the patent to Koren is also inoperable when a broadhead tipped arrow is employed. Such an arrow will simply not clear the detector in front of the bow shank to provide the necessary indicating signal in the Koren apparatus. Additionally, the apparatus of Koren employs a mercury switch for insuring horizontal bow operation. However, much successful hunting is accomplished from tree stands or similar cover in which the bow cannot be maintained in a horizontal position. Accordingly, the draw length indicating device in the Koren patent is not effective for use on bows where the intended function is that of hunting.

There is also apparently disclosed an archery release indicating assembly for use with an archery bow in U.S. Pat. No. 3,866,592 issued Feb. 18, 1975 to Richard F. Carella. The device in this patent employs a mechanical bracket, spring and trip device for providing an audible sound, indicating to the archer that the arrow should be released. However, it should be noted that audible signals are generally undesirable in hunting situations. A similar audible signalling device for a draw length indicator is also apparently shown in U.S. Pat. No. 3,499,414 issued Mar. 10, 1970 to Arthur J. Frydenlund. Again, the disadvantages of an audible signal are noted. Another audible signal producing device is apparently shown in U.S. Pat. No. 3,669,059 issued June 13, 1972 to Frank T. Stuart. In this device, an audible "clacker" includes two metal strips of aluminum and a spring element sandwiched between the metal strips together with an adhesive member that is used to attach the member to the bow. The spring element appears to be biased outward from the bow by an arrow during the drawing of the bow but when the spring element moves out of engagement with the arrow, the spring element slaps the bow and produces the audible signal to indicate that the arrow has been drawn the proper distance. Lastly, there is apparently provided in U.S. Pat. No. 4,183,346 issued Jan. 15, 1980 to Fernando V. Trancosso, Jr., a device for providing an adjustable draw check or stop to indicate draw length. However, it appears that in addition to being significantly different from the present invention, that it also has the signal disadvantage of interference with the arrow's fletchering.

Accordingly, draw length indicators previously employed by those in the archery arts have not properly addressed the problems of the archery enthusiast who is also a hunting aficionado.

SUMMARY OF THE INVENTION

In accordance with a preferred embodiment of the present invention a draw length indicator for an archery bow comprises a base plate for attachment to the bow, a signal means affixed to the base plate, battery means for supplying electrical energy to the signal means and a magnetic switch attached to the base plate for connecting the battery to the signal means, the switch being disposed so as to extend forwardly from the bow. In another preferred embodiment of the present invention the draw length indicator is affixed to a bow. The present invention takes advantage of the ferrous material employed in many present day commercially available arrowheads for triggering the magnetic switch means. In operation, the switch means connects the battery means to a signal means such as an LED (light-emitting diode), which is the preferred signalling device for the present invention. In another embodiment of the present invention the signal means may be mounted in a sight for easy viewing. The base plate of the present invention is preferably a conductive metal such as aluminum and typically forms part of the electrical circuit. A significant advantage of the present invention is that the magnetic switch is adjustable in a generally horizontal direction to control sensitivity and in a direction generally parallel to the arrow shaft to accomodate varying length arrows and individual draw lengths and tip shapes.

Accordingly, it is an object of the present invention to provide an indicator for use on an archery bow to indicate, in an unobtrusive manner, to the archer that the proper bow string tension is being employed.

It is a further object of the present invention to provide a draw length indicator which is removable yet easily attachable to commercially available wooden or metal bows.

It is also an object of the present invention to provide a draw length indicator which indicates overdraw or lack of a straight draw.

Lastly, it is an object of the present invention to provide a draw length indicator which is particularly useful for the hunting archer.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
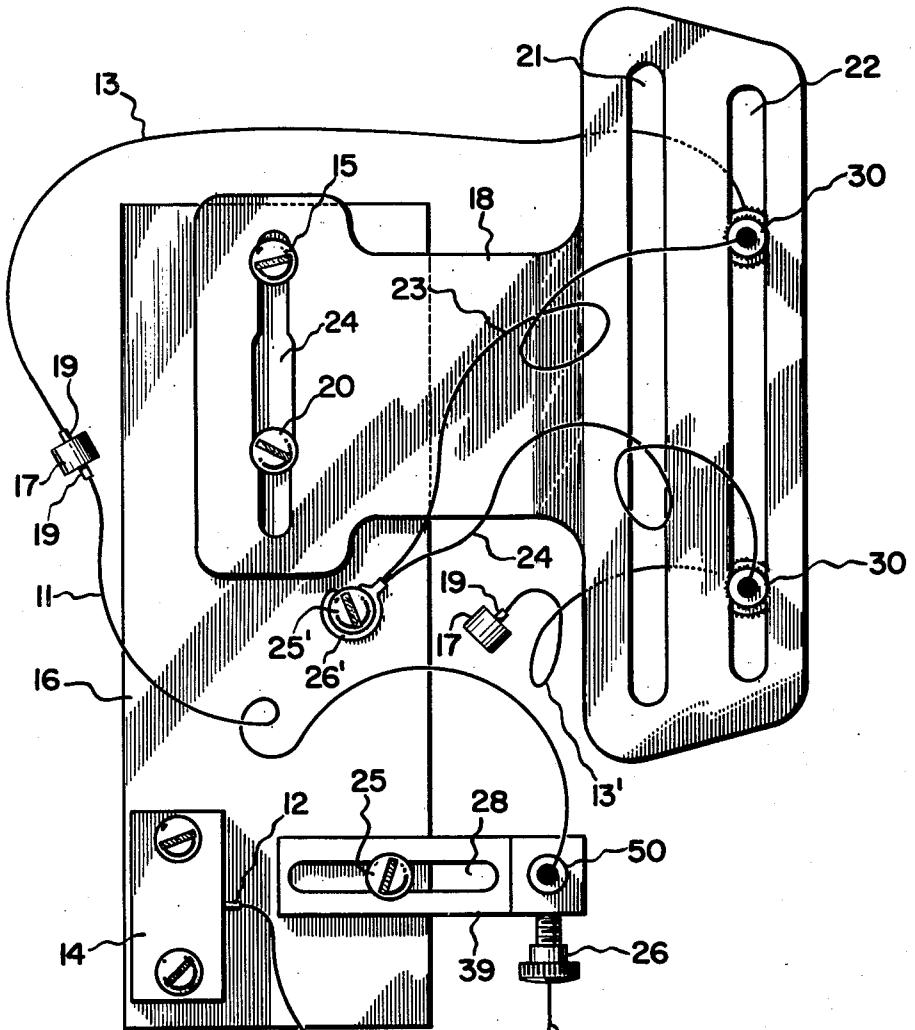
FIG. 1 is a side elevation view illustrating one embodiment of the present invention.

FIG. 1 illustrates one embodiment of the present invention in the form of assembly 10 which may be affixed to an archery bow. In particular there is shown base plate 16, preferably comprising a conductive material such as aluminum and on which there is fixed battery pack 14 which is connected through clip 12 to lead 27 which completes the circuit between one side of the battery in pack 14 and one side of switch 50. Lead 27, which is of course, preferably insulated, extends through a centrally located aperture in fluted screw 26 which serves to lock switch 50 into bracket 39 and also to hold an exposed end of lead 27 against an exterior conductive portion of switch 50. Accordingly, screw 26 may also may also be employed to provide adjustability to switch 50 by permitting it to be variably positioned in a generally horizontal direction so as to control the sensitivity of the instant indicating device. Bracket 39 is preferably fastened to base plate 16 by means of screw 25 disposed through slot 28. The presence of slot 28 permits adjustability of the switch in a second direction which is generally either toward or away from the front portion of the bow itself. If, desired screw 25 may also include a washer (not shown) for more secure attachment.

Also shown in FIG. 1 is sighting bracket 18 with slots 21 and 22. This bracket is generally a commercially available item and is employed for mounting sights 30 such as those more particularly illustrated in FIG. 2. Bracket 18 is affixed to the base plate and/or bow itself through screws 15 and 20. Slot 29 in bracket 18 permits further vertical adjustability of sighting bracket 18. It should also be noted here that the present invention takes advantage of the fact that many commercially made present day archery bows comply to certain archery standards which require specific positioning and thread sizes for threaded apertures in the shank of the bow itself. It is into these apertures that screws 15 and 20 are inserted. Accordingly, the present invention is easily adapted to many modern bows and is equally detachable therefrom for placement on another bow with similarly standardized apertures. Thus even though these apertures are generally provided for sighting bracket 18, the present invention takes advantage of this fact to provide a readily detachable draw length indicating assembly which may be marketed with or without a corresponding bow attached.

With respect to switch 50 in FIG. 1, it has already been noted that lead 27 is electrically connected to one side thereof. Additionally, lead 11 is electrically connected to the other side of switch 50, which is generally configured to be a normally open switch. In the embodiment of the present invention shown lead 11 is typically soldered to a portion of switch 50 on one end and is connected to clip 19, such as the flea clips generally employed in electrical breadboard circuit construction. Clips 19 generally extend through and are generally force fit through an aperture in bushing 17 which preferably comprises a non-conducting material such as nylon. The use of such bushings render the present invention readily manufacturable, economical, but yet sufficiently rugged for the intended purpose. Other connection means are also readily employable. Lead 11 is connected to leads 13 or 13' which are connected to the ungrounded side of light emitting diode 35 (see FIG. 2). The other, grounded side, of the light emitting diodes shown are connected to the ground through either leads 23 or 24 which are connected to terminal lug 26' which is affixed to conducting base plate 16 by means of screw 25'. It should be understood in the present invention that screws 15 and 20 extend through the entirety of base plate 16 and into the shank of the bow. In contrast, the other screws illustrated do not generally extend through the base plate.

Figure 2:
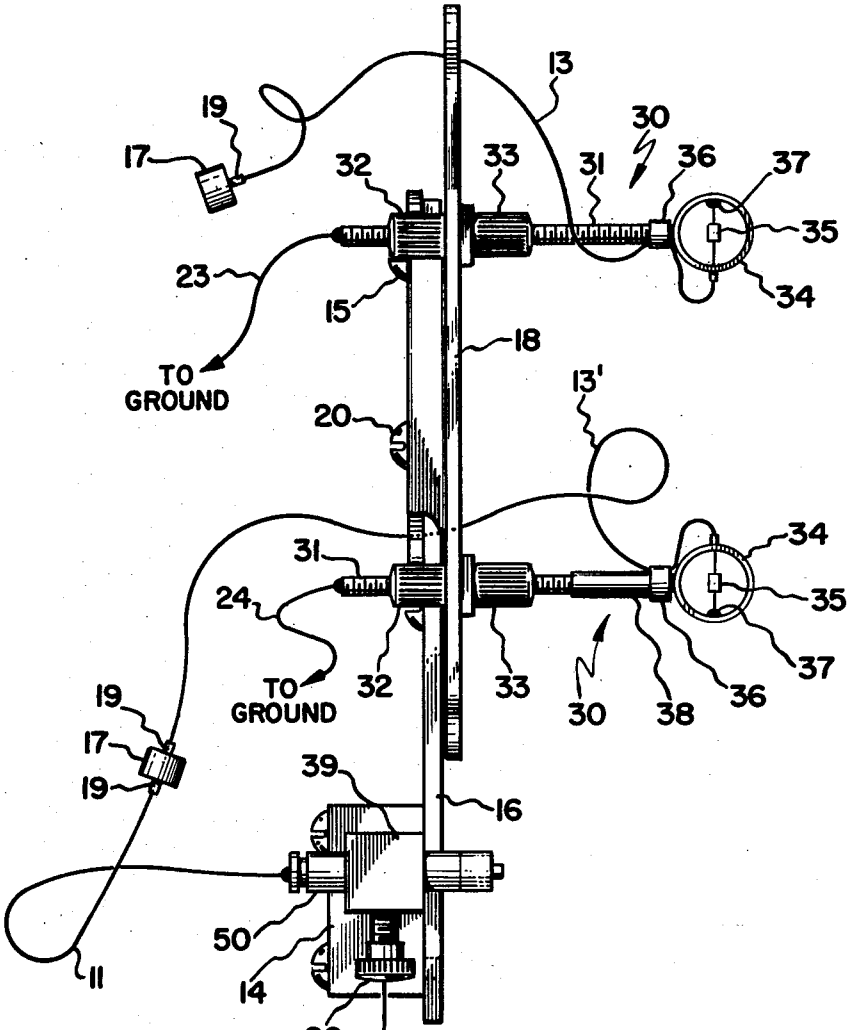
FIG. 2 is a front elevation view of the embodiment of the present invention illustrated in FIG. 1.

FIG. 2 is another view of the apparatus shown in FIG. 1 and it more particularly illustrates upper and lower sights 30. In the embodiment shown each of these sights possesses a light emitting diode 35. It should also be noted in the present invention that if light emitting diodes are employed, proper battery polarity must be observed to effect light production from the diode.

FIG. 2 also particularly illustrates the fact that dual, that is, upper and lower, sights may be employed and either of them may employ a light emitting diode connected to function as a light signal in the manner of the present invention, that is, in conjunction with switch 50 to indicate draw length. If the lower sight is actually used for aiming, it may be desirable to employ the light emitting diode 35 in the upper sight to indicate draw length, or it may be desirable to have the light emitting diode 35 operate not only in the aiming function but also operate as a signal means for the draw length indicator of the present invention. Since similar components are referred to herein using the same reference numeral, only the sight portions of FIG. 2 need be discussed in the instant paragraph. In this way unnecessary redundancy is avoided. Both upper and lower sights 30 are affixed to bracket 18 by means of non-conductive threaded nuts 32 and 33. Fastening nut 33 preferably includes a squared shoulder for slidable but non-rotating movement of sights 30 within slot 22. These nuts are commercially available for mounting the sight rings shown. Each sight includes threaded conductive bolt 31 which typically comprises material such as brass. At the end of each of these bolts there is disposed a generally metallic sighting ring 34 in which there is centrally disposed an LED 35 electrically connected to conducting ring 34 through solder blob 37. Of course if sight ring 34 comprised a non-conductive material, then dual wire leads to the LED would have to be provided. However, the illustrated arrangement provides not only for an LED signalling device but also for the LED component to operate as part of the aiming function of the sight. Wire leads 13 and 13', extending from the ungrounded side of the LED may be conveniently passed through elastic collars 36 to provide stress relief and to generally maintain the wire leads in a desirable position. Lower sight 30, for example, may also be fashioned in a slightly different way in that sight ring 34 may be directly affixed, as by welding or soldering, to changeable threaded collar 38. This permits somewhat greater flexibility in the horizontal positioning of sight ring 34. Threaded collar 38 also permits mounting of sight rings 34 on a variety of commercially available sight pins. This provides the archer with a choice of using sight rings or sight pins. Moreover, sight pins may be employed which also include a draw length signalling light. The indications that leads 23 and 24 are directed to ground actually imply that these leads may be generally connected to conductive base 16 which preferably acts as an electrical ground and part of the electrical circuit. Lastly, FIG. 2 more particularly illustrates the fact that screw 26 permits a horizontal adjustability for switch 50 which passes through an aperture in bracket 39 which preferably comprises a non-conductive material such as nylon or other convenient plastic. It should be pointed out that nylon is a preferable material for many of the non-conductive components of the present invention since it is not only rugged but is also easily machinable.

Figure 3:
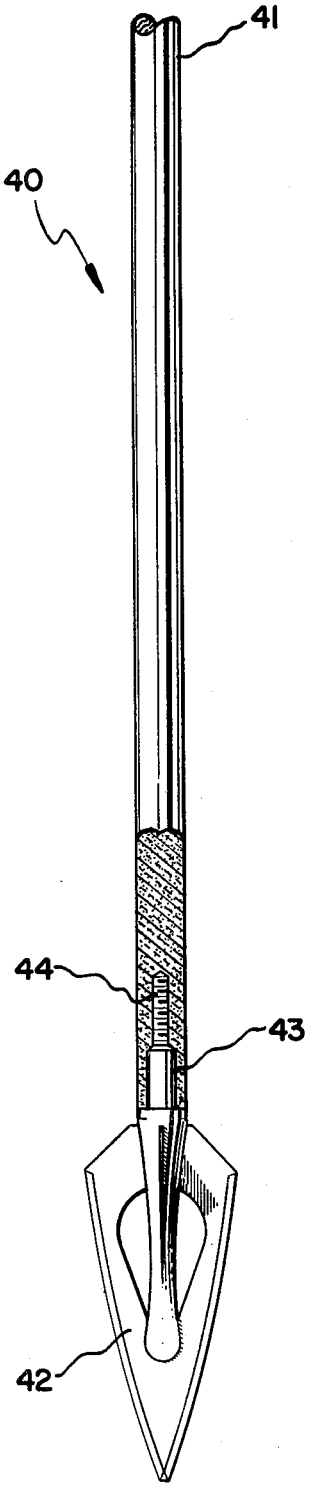
FIG. 3 is a partial cross-sectional side elevation view showing an arrow with a broadhead tip.
Figure 4:
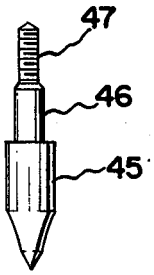
FIG. 4 is a side elevation view of an alternate tip that may be employed with the arrow of FIG. 3.

FIG. 3 illustrates a typical broadhead arrow 40. These arrows possess tip 42 such as that shown in the figure along with a metal shank portion 43 having screw end 44 for attachment to shaft 41 of the arrow itself. The shaft is typically alumiunum or a non-conductive material such as glass fiber, or even in some cases, wood. However, the nature of the broadhead tip 42 is such that it does not permit the arrow to be drawn back sufficiently far to engage conventionally employed draw length indicators. FIG. 4 illustrates an alternate tip which may be employed on arrows which are, nonetheless, compatible with the present invention. This is a conventional steel tipped arrow with tip 45, metal shank portion 46 and screw end 47 for fastening to arrow shaft 41. The differences in these arrow tips clearly indicate the inability of the broadhead tipped arrow to be drawn back past the shank of the bow. This fact is more clearly indicated in FIG. 6 in which a broadhead tipped arrow 40 is shown in dotted lines.

Figure 5:
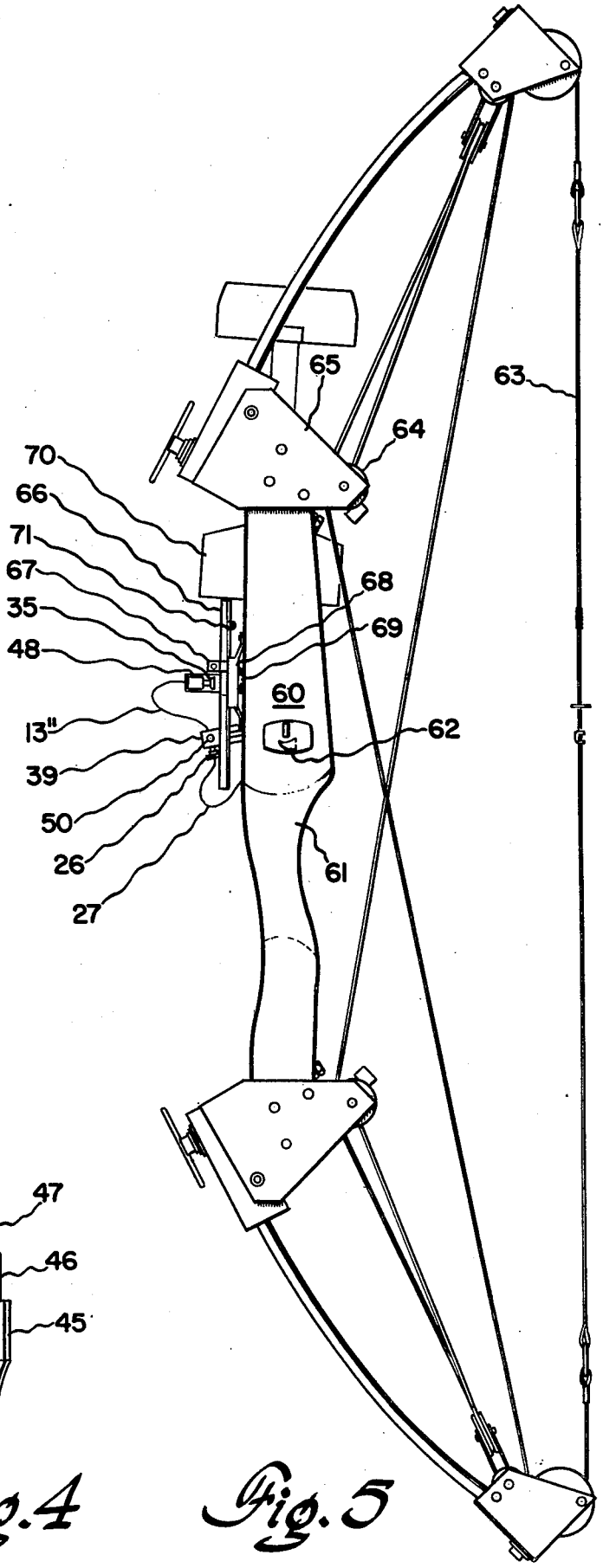
FIG. 5 is a side elevation view illustrating one embodiment of the present invention employed upon a modern compound bow.
Figure 6:
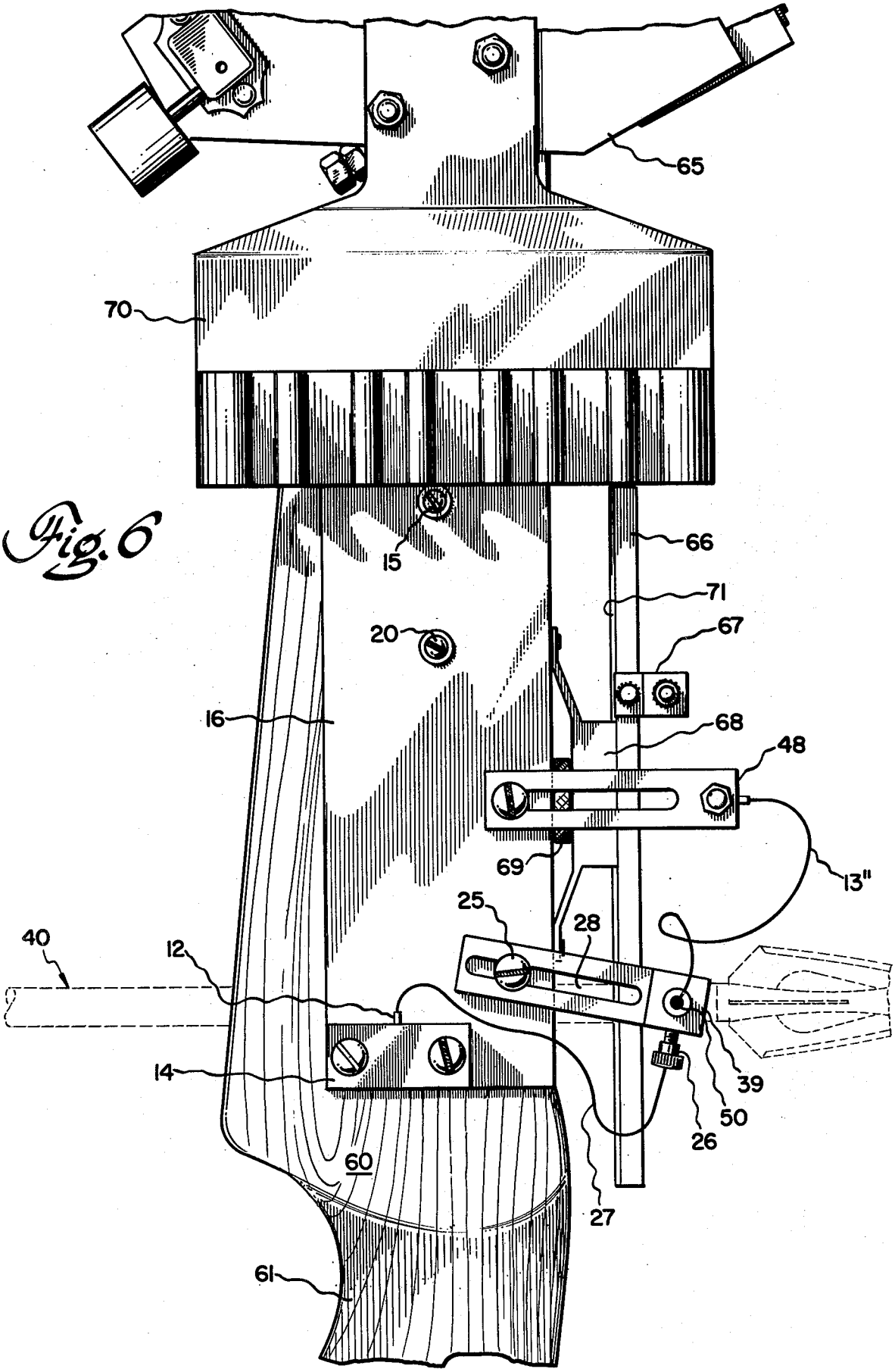
FIG. 6 is a detailed view illustrating the present invention in place on the bow of FIG. 5.

FIG. 5 illustrates the use of the present invention on a conventional, modern, compound archery bow. In particular, the bow possesses shank 60 with handgrip 61, arrow rest 62 and draw string 63 threaded through various pulleys of the bow. In FIG. 5, the apparatus of the present invention is mounted on the obverse, rather than the facing side of the bow. In particular, there is shown switch 50 mounted in bracket 39 with leads 27 and 13" extending from the switch, lead 27 being connected to the ground and lead 13" being connected to an LED light source 35. The light source is, for example, mounted on bracket 48. Bracket 48, shown in more detail in FIG. 6, is especially useful if lighted pin sights are desired. As seen in FIG. 6, bracket 48 comprises a conductive material and is in electrical connection with base plate 16. This configuration eliminates the need for one wire lead. It should also be noted that bracket 48 generally replaces commercially available bracket 18 seen in FIG. 1. Bracket 48 is also capable of being mounted facing the opposite side of the bow shank if the hunter so desires, in which case conventionally employed sights may also be used. The light means 35 seen in FIG. 5 is also unique in that the light faces only the hunter and prevents its being viewed by the quarry. It is also seen, from FIG. 5, and also from FIG. 6 that the use of the present invention is compatible with the simultaneous use of conventionally employed quiver 70. However, it should be noted that the present invention is completely compatible with the use of many varieties of popularly employed quivers, not just the one shown.

Other assemblies commonly found on compound bows such as that illustrated, include brass guide rail 66 attached to bow shank 60 by means of bracket 68 and being adjustable by means of knurled knob 69. Sighting track 66 includes a groove 71 therein for mounting of conventional bow sight 67. It is also worthy of note that in such bows, bow string tension may be adjusted at pulley 64 mounted within bracket 65 at one end of the bow shank. However, an understanding of this mechanism is unimportant to an understanding of the construction and operation of the present invention.

FIG. 5 also is important in that it illustrates a feature of the present invention not found at all in prior art draw length indicators. In particular, the present indicator also simultaneously indicates that the arrow is not being drawn back straight. For example, if during the draw, the archer pulls the tail end of the arrow to his left, the arrow is pivoted about arrow rest 62 so that the tip of the arrow is pressed against switch 50 thereby holding it in an open position. In such a position, more specifically seen in FIG. 7, no current flows in the indicator circuit and the lamp remains unlit. In this manner, the archer is informed that his positioning of the arrow is improper. In short, the present indicator assembly acts as a "go-no go" signal to the archer. It is especially important to note that this feature of the invention is made possible by the specific positioning of the actuating switch in a position forward of the bow shank, or riser 60, as it is commonly called. Moreover, if during the draw, the archer pulls the tail of the arrow to his right, the arrow is pivoted about arrow rest 62 so that the tip of the arrow is moved away from actuating switch 50. When switch 50 is properly positioned within bracket 39, this movement of the arrow tip prevents the actuation of switch 50 since the magnetic material is removed from the proximity of magnet 52 (see FIG. 7). In this way, if the arrow is not drawn back straight, the archer is not given a "green light" for the release of his arrow. If the arrow is drawn back either too far to the left or too far to the right, the lack of lamp lighting tells him that the arrow is not yet in a position to release. This function is provided in addition to the other principal function disclosed herein, namely that of draw length indication, which provides both for over draw and underdraw indications.

The features of the present invention illustrated in FIG. 5 are shown in greater detail in FIG. 6 which more particularly shows conductive base plate 16 and battery pack 14. Plate 16 is mounted to the bow shank with screws 15 and 20 in mounting hole positions which are conventionally provided. Moreover, plate 16 may be provided in any convenient shape to match a variety of commercially manufactured bows. Base plate 16 may also comprise, if desired, a material such as plastic or similar molded material in which electrical conductors are embedded or plate 16 may be provided in a form similar to that found in conventional printed circuits. In any event, the present invention generally requires no modifications of commercially available archery bows. Also shown in FIG. 6 is adjustment and holding screw 26 which holds switch 50 in bracket 39. Additionally, screw 25 in slot 28 is also provided for further adjustment of the switch position and more particularly, in the present invention, it serves to extend the switch into a position which accomodates broadhead tipped arrows. FIG. 6 is however most significant for the appreciation it provides of the fact that broadhead tipped arrows cannot be drawn back to a sufficient position to trigger previously employed draw length indicators. In the event that shank 43 of broadhead tip 42 is non-ferrous, bracket 39 is adjusted, using screw 25 in slot 28, to position switch 50 to a generally more forward position to provide the same draw length. In such cases, switch 50 is triggered by the presence of ferrous material in tip 42 itself. In the present invention, this is the preferred positioning of switch 50 since ferrous material in shank 43 can sometimes be ineffective in triggering switch 50 unless especially strong magnets are employed. In the present invention switch 50 is preferably activated by the presence of ferrous material in the rearward portion of broadhead tip 42, as opposed to such material in shank 43 or screw portion 44. Accordingly, in the preferred mode of operation of the present invention, the broadhead tipped arrow is actually preferably rotated by an angle of about 45 degrees, from the position shown, about the arrow shaft, to prevent switch 50 from contacting the edges of the broadhead blade tips. In prior art devices, it is contact between the broadhead blade tips and riser 60 which forces the whole arrow off arrow rest 62. In the preferred mode of operation of the present invention, if the arrow is overdrawn, the shape of the broad head tip is such that ferrous material is removed from the proximity of switch 50 thereby turning off the indicator light. In this manner the present invention also provides an overdraw signal.

Figure 7:
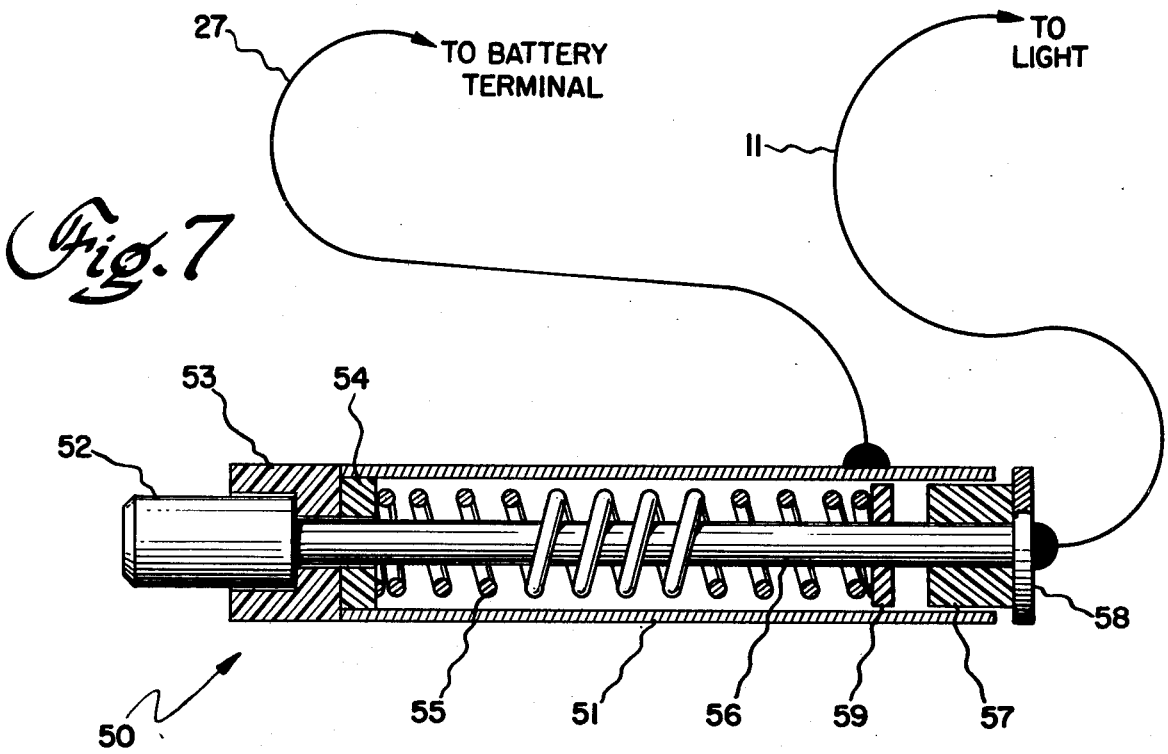
FIG. 7 illustrates one form of magnetic switch which may be employed in the present invention.

FIG. 7 shows one configuration of switch 50 which may be employed in the present invention. In particular, there is shown outer conductive cylindrical casing 51. Disposed within one end of the casing there is non-conductive washer 54 force fit into the end of casing 51. It is against washer 54 that spring 55 exerts its expansive force. Shaft 56 which may comprise either conductive or non-conductive material; however, a metallic material is preferably used. Shaft 56 is disposed through the opening in washer 54 and is slidable therethrough. At the other end of the shaft from washer 54 there is disposed washer 59 also preferably comprising a non-conductive material such as nylon, the washer being force fitted to shaft 56 but slidable within casing 51. If washer 59 comprises electrically conductive material, clearance must be maintained between it and casing 51. It is against washer 59 that spring 55 also exerts its expansive force tending to maintain coductive end cap 58 at a distance from conductive casing 51. Spring 55 is carefully selected to be just sufficiently stiff to maintain the switch in a normally open position. Additionally, for smoothness of operation switch 50 is conveniently provided with non-conductive bushing 57 to provide a smooth stroke to the action switch 50. This bushing is either force fit onto shaft 56 or into casing 51, but not both. To outer conductive casing 51 there is soldered or otherwise attached lead 27. In a similar fashion lead 11 may be soldered or otherwise attached to conductive cap 58. At the other end of switch 50 from cap 58 there is disposed magnet 52 which is force fit into non-conductive bushing 53 into which shaft 56 is also force fit to complete assembly of switch 50. The assembly illustrated provides a convenient, economical, reliable, noiseless and smoothly acting switch. The switch is normally open, but, when a ferrous portion of an arrow, including shank 43 or 46, are brought in proximity to magnet 52, shaft 56 acts to draw conductive cap 58 into electrical connection with outer conductive casing 51 thus closing the circuit. It is also to be noted that switch assembly 50 is slidable within bracket 39 to provide a measure of sensitivity control to the apparatus of the present invention.

Figure 8:
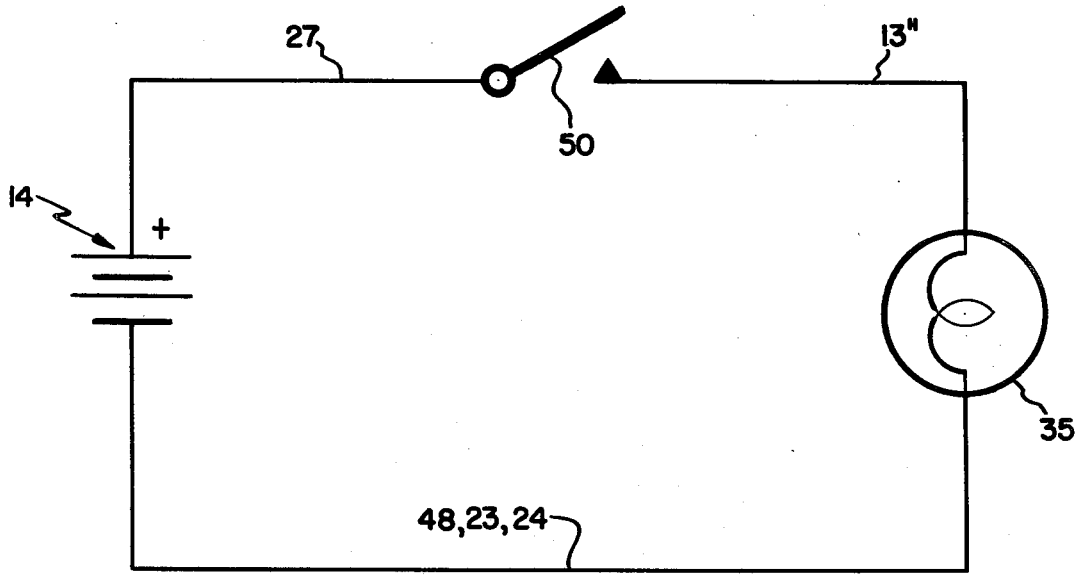
FIG. 8 is an electrical circuit schematic diagram generally indicating the circuit employed in the present invention.

For completeness, an electrical circuit diagram of the present invention is shown in FIG. 8. In particular there is shown battery pack 14 with lead 27 to switch 50 and lead 13" extending from switch 50 to light source 35. From the other end of the battery pack either leads 23 or 24 or bracket 48 connects to the light source 35. It should be noted that, as above, that if the light source is indeed an LED, proper polarity with respect to the battery pack must be observed.

From the above it should be appreciated that the apparatus of the present invention provides a draw length indicator for an archery bow which is particularly useful to the hunting archer. In particular, the present invention is detachably mountable to many conventional bows and is especially useful in conjunction with the employment of broadhead tipped arrows. The apparatus of the present invention is rugged and reliable, and of most importance to the hunting archer, silent and invisible to the quarry. The present invention is useable from tree stands or other positions and need not be held horizontally to operate. The present invention also indicates overdraw and lack of straight draw. In short, the present invention provides significant advantages over other draw length indicators previously employed or described.

While this invention has been described with respect to particular embodiments and examples, other modifications and variations will occur to those skilled in the art in view of the above teachings. Accordingly, it should be understood that within the scope of the appended claims, the invention may be practiced otherwise than is specifically described.

The invention claimed is:

1. A draw length and arrow pivot indicator for an archery bow which includes a flexible member operatively bending substantially in a plane containing the flexible member, said indicator comprising:

a base plate for attachment to said bow;

signal means affixed to said base plate for providing an indication of readiness in response to the operative positioning of an arrow in said bow;

battery means for supplying electrical energy to said signal means;

magnetic switch means, attached to said base plate for electrically connecting said battery means to said signal means so as to actuate said signal means, said switch means being disposed so as to extend forwardly from said bow, in the direction traversed by a released arrow, said switch means being operative to connect said battery means to said signal means to provide an indication that an arrow positioned in said bow has been drawn back a specified distance and to provide an indication that said arrow lies substantially in the plane defined by said flexible member, whereby an arrow readiness signal is provided when the arrow has been drawn back to a specified position and when the arrow is simultaneously disposed substantially in the plane defined by said flexible member, said plane being substantially the plane in which said flexible member bends.

2. The apparatus of claim 1 in which said switch means is adjustable with respect to controlling the sensitivity of said switch to presence of ferrous material.

3. The apparatus of claim 1 in which said switch means is adjustable so as to extend forwardly a variable distance from said bow.

4. The apparatus of claim 1 in which said signal means comprises at least one LED.

5. The apparatus of claim 1 in which said signal means includes an LED mounted in a sight.

6. The apparatus of claim 1 in which said base plate is conductive and serves as a current flow path.

7. The apparatus of claim 1 further including: an archery bow having a base plate mounted thereon.

* * * * *